US006216295B1

(12) United States Patent
Pearson

(10) Patent No.: US 6,216,295 B1
(45) Date of Patent: Apr. 17, 2001

(54) ADJUSTABLE BED

(75) Inventor: Stephen Pearson, Wiltshire (GB)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/403,074

(22) PCT Filed: Apr. 14, 1998

(86) PCT No.: PCT/US98/07643

§ 371 Date: Jan. 10, 2000

§ 102(e) Date: Jan. 10, 2000

(87) PCT Pub. No.: WO98/46185

PCT Pub. Date: Oct. 22, 1998

(30) Foreign Application Priority Data

Apr. 17, 1997 (GB) ..... 9707776

(51) Int. Cl.[7] ..... A61G 7/00

(52) U.S. Cl. ..... 5/618; 5/613; 5/616

(58) Field of Search ..... 5/613, 616, 617, 5/618

(56) References Cited

U.S. PATENT DOCUMENTS

| | | | |
|---|---|---|---|
| D. 255,402 | 6/1980 | Lundgren | D6/382 |
| 3,402,408 | 9/1968 | Hutt | 5/618 |
| 3,581,320 | 6/1971 | Degen | 5/617 X |
| 3,593,350 | 7/1971 | Knight et al. | 5/616 |
| 3,599,963 | 8/1971 | Grover | 5/618 |
| 3,644,946 | 2/1972 | Swatt | 5/616 |
| 3,686,696 | 8/1972 | Lanigan | 5/616 X |
| 3,693,200 | 9/1972 | Stafford | 5/617 |
| 3,793,652 | 2/1974 | Linehan et al. | 5/616 X |
| 3,821,821 | 7/1974 | Burst et al. | 5/616 |
| 3,898,702 | 8/1975 | Goodman | 5/618 |
| 3,919,727 | 11/1975 | Paine | 5/617 X |
| 3,965,500 | 6/1976 | Stein, Jr. | 5/618 |
| 3,982,741 | 9/1976 | Mitchell et al. | 5/614 |
| 4,005,497 | 2/1977 | Sutter | 5/617 |
| 4,057,240 | 11/1977 | Damico et al. | 5/617 X |
| 4,095,296 | 6/1978 | Ferro | 5/616 |
| 4,097,940 | 7/1978 | Tekulve et al. | 5/616 |
| 4,218,788 | 8/1980 | Steckmesser | 5/617 |
| 4,225,988 | 10/1980 | Cary et al. | 5/617 X |
| 4,227,269 | 10/1980 | Johnston | 5/616 X |
| 4,307,477 | 12/1981 | Jacobsen | 5/618 |
| 4,336,621 | 6/1982 | Schwartz et al. | 5/658 |
| 4,361,917 | 12/1982 | Wilson | 5/616 |
| 4,371,996 | 2/1983 | Nahum | 5/618 |
| 4,376,316 | 3/1983 | Mercier et al. | 5/618 |
| 4,380,838 | 4/1983 | Lutchansky | 5/618 |
| 4,381,571 | 5/1983 | Elliott | 5/616 |
| 4,385,410 | 5/1983 | Elliott et al. | 5/616 |
| 4,407,030 | 10/1983 | Elliott | 5/616 |

(List continued on next page.)

*Primary Examiner*—Terry Lee Melius
*Assistant Examiner*—Robert G. Santos
(74) *Attorney, Agent, or Firm*—Wood, Herron & Evans, L.L.P.

(57) ABSTRACT

An adjustable bed is provided having a lower frame (1) and an upper frame (3) mounted for longitudinal movement on the lower frame. A supporting surface (7, 8, 9, 10), including a back support member (7), is connected to the upper frame for pivotal movement about a transverse axis. The back support (7) is adjustable by an adjustment mechanism comprising two pairs of pivotally interconnected arms (17, 19), one of each pair being also pivoted to the lower frame (1) and the other arm of each pair being pivoted to the upper frame (3). The pivotal interconnections (18, 20) between the arms bear on the underside of the back support members, and a drive mechanism (13, 14, 15, 16) produces longitudinal movement of the upper frame with respect to the lower frame and, simultaneously, vertical movement of the pivotal interconnection (18).

8 Claims, 3 Drawing Sheets

U.S. PATENT DOCUMENTS

Figure 1:
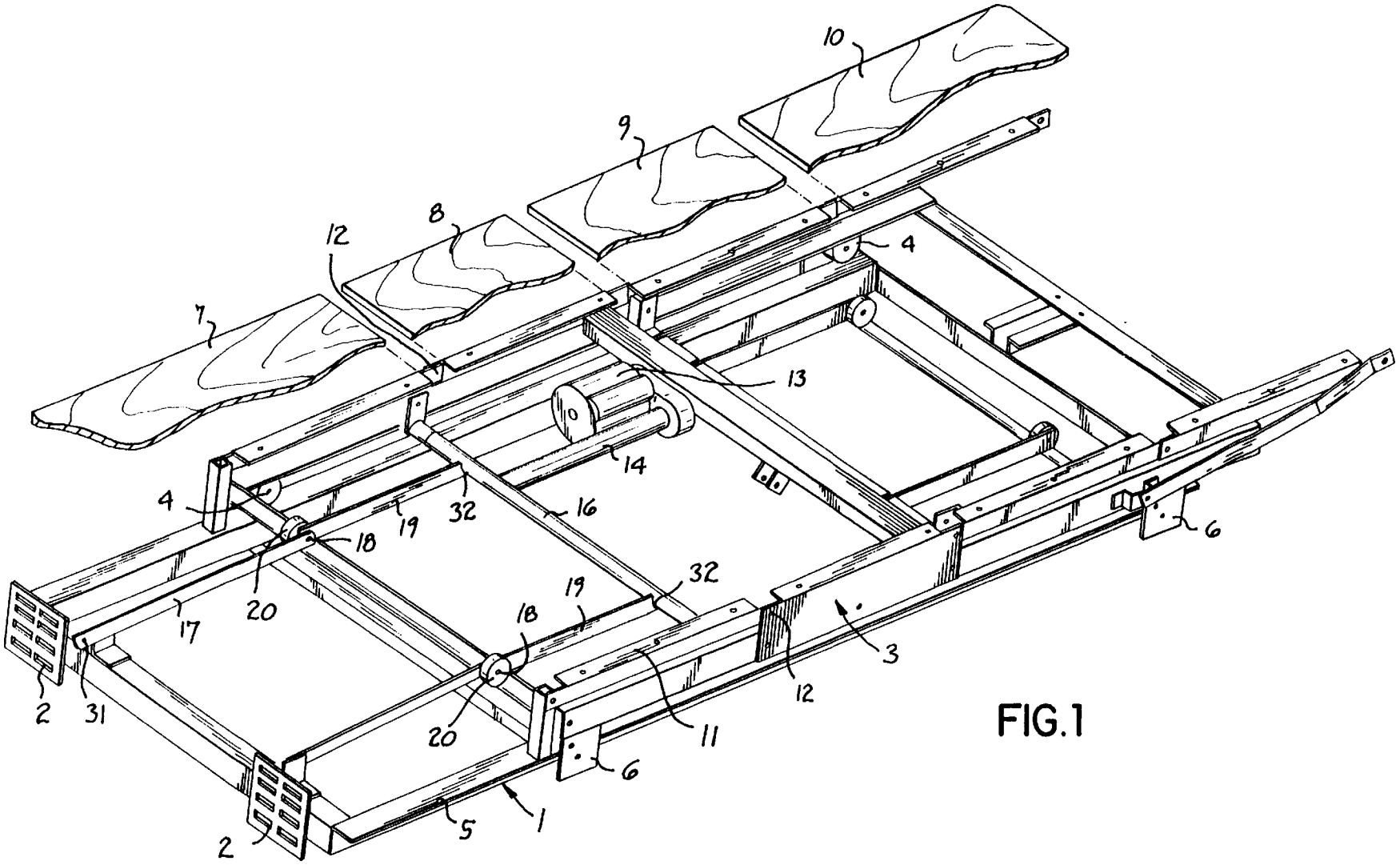

| | | | |
|---|---|---|---|
| 4,494,259 | 1/1985 | Miller et al. | 5/616 |
| 4,559,655 | 12/1985 | Peck | 5/616 |
| 4,592,104 | 6/1986 | Foster et al. | 5/616 |
| 5,317,769 | 6/1994 | Weismiller et al. | 5/616 X |
| 5,329,657 | 7/1994 | Bartley et al. | 5/617 |
| 5,369,826 | 12/1994 | Ikeda | 5/613 |
| 5,388,290 | 2/1995 | Shirai | 5/236.1 |
| 5,438,723 | 8/1995 | Carroll | 5/620 |
| 5,469,588 | 11/1995 | DiMatteo et al. | 5/612 X |
| 5,490,298 | 2/1996 | Goldsmith et al. | 5/613 X |
| 5,537,701 | 7/1996 | Elliott | 5/617 |
| 5,544,376 | 8/1996 | Fromson | 5/618 |
| 5,561,878 | 10/1996 | Ruehl | 5/621 |
| 5,568,661 | 10/1996 | Bathrick et al. | 5/618 |
| 5,577,280 | 11/1996 | Elliott | 5/618 |
| 5,579,550 | 12/1996 | Bathrick et al. | 5/618 X |
| 5,600,214 | 2/1997 | Fromson | 318/120 |
| 5,608,932 | 3/1997 | Hasegawa | 5/613 X |
| 5,634,222 | 6/1997 | Zwickey | 5/628 |
| 5,640,730 | 6/1997 | Godette | 5/618 |
| 5,682,631 | 11/1997 | Weismiller et al. | 5/618 |
| 5,687,437 | 11/1997 | Goldsmith | 5/613 X |
| 5,862,551 | 1/1999 | Oguma et al. | 5/618 |
| 5,870,874 | 2/1999 | Elliott | 5/618 |
| 5,916,086 | 6/1999 | Rossdeutscher | 5/613 X |
| 6,006,379 * | 12/1999 | Hensley | 5/618 |
| 6,101,647 * | 8/2000 | Stroud et al. | 5/618 |

* cited by examiner

ADJUSTABLE BED

This invention relates to an adjustable bed. Such beds are used in hospitals, and are also used in domestic situations and in homes for the elderly and infirm, where it is necessary to have a bed which can be adjusted to suit a particular individual.

In such beds the mattress rests on a supporting surface which normally consists of three or four sections pivotally connected to one another. In the case of a four-section supporting surface these are, starting from the head end of the bed, a back section, a buttocks section, a thigh section and a calf section. In the case of a three-section supporting surface the thigh and calf sections are replaced by a single section, or the buttocks section is omitted. The sections are connected to one another in such a way as to allow pivotal movement between adjacent sections about parallel axes transverse to the length of the bed.

One problem which exists with many types of adjustable beds is that as the back section of the supporting surface is pivoted from a horizontal orientation to an inclined position, the upper portion of the user's body, and, therefore, the user's arms, are moved longitudinally in a direction away from the head end of the bed. Commonly, the user will have a bedside cabinet or other surface on which the user's requirements while in bed can be placed, and if this is positioned so that it is convenient for the user to reach when lying flat, it may be rearwardly of the user when the user is sitting up and therefore inconvenient, or even impossible, to reach.

It is an object of the present invention to provide a bed in which, by means of a simple mechanism, the upper portion of the user's body can be kept at least approximately at the same position during pivoting movement of the back section of the supporting surface, so that the aforementioned problem does not arise.

According to the present invention there is provided an adjustable bed having a head end and a foot end, comprising a lower frame, an upper frame mounted on the lower frame for longitudinal movement with respect thereto; a supporting surface defined by a plurality of support members including at least a back support member adjacent the head end of the bed and connected to the upper frame for pivotal movement about a transverse axis; and back support adjustment means comprising:

- at least one first arm pivotally connected to the lower frame at a first pivotal connection adjacent the head end thereof;
- at least one second arm pivotally connected to the upper frame at a second pivotal connection adjacent the said transverse axis;
- means pivotally connecting the first and second arms to one another at a third pivotal connection intermediate the said first and second pivotal connections;
- support means, carried by the said third pivotal connection, arranged to support the back support member;
- and drive means, preferably connected between the upper frame and the said second pivotal connection, for producing longitudinal movement of the upper frame with respect to the lower frame and, simultaneously, vertical movement of the third pivotal connection and, thereby, upward pivotal movement of the back support member, movement of the upper frame towards the head end occurring when the third pivotal connection moves upwards, and movement of the upper frame towards the foot end occurring when the third pivotal connection moves downwards.

Preferably, the drive means comprises a motor mounted on the upper frame at a location nearer the foot end of the bed than the second pivotal connection, the motor serving to cause movement in a generally longitudinal direction of an actuator member the distal end of which is connected to the second pivotal connection in such a way as to cause the second arm to pivot and the upper frame to move longitudinally.

Figure 2:
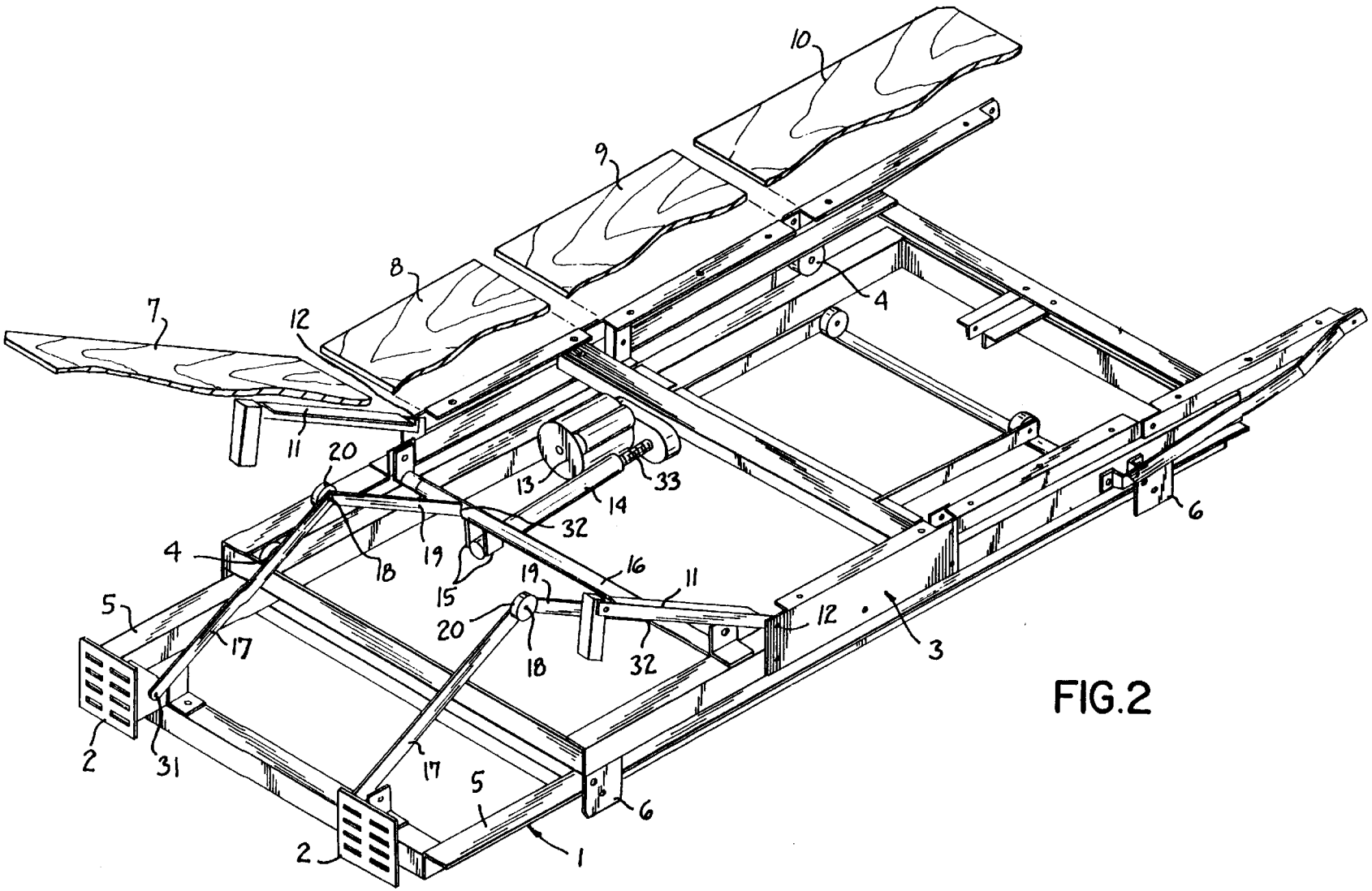
Figure 3:
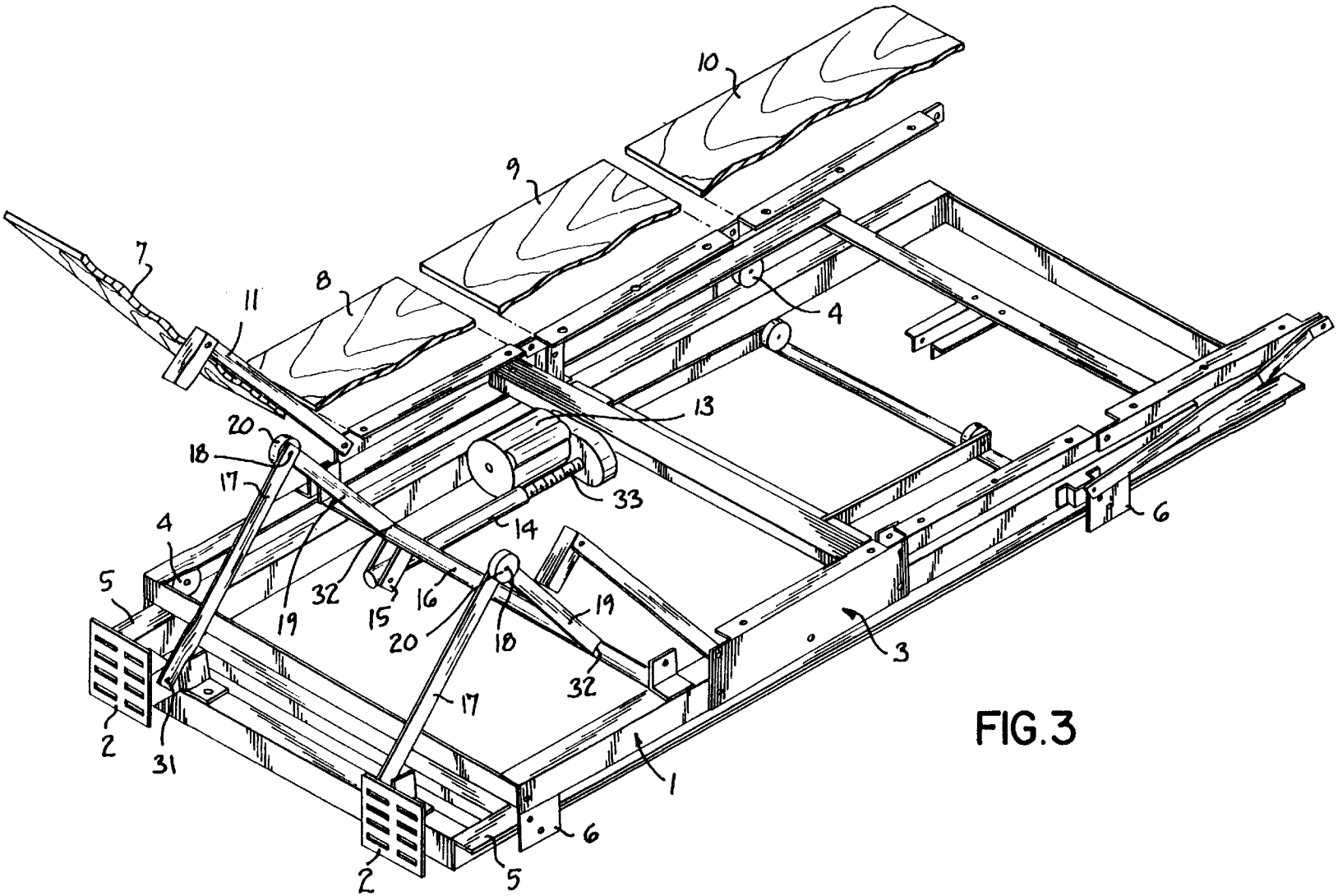

An embodiment of the invention is shown in the accompanying drawings, in which FIGS. 1 to 3 are isometric views showing the upper part of a bed with the back support member horizontal (FIG. 1), partly pivoted upwardly (FIG. 2), and fully pivoted upwardly (FIG. 3).

The bed comprises a lower frame 1 with connector plates 2 at the head end for attachment of a headboard (not shown) at the head end, and connectors (not shown) for the attachment of legs to the lower frame adjacent the head end and foot end. An upper frame 3 is mounted on the lower frame for longitudinal movement with respect thereto. For this purpose, the upper frame is provided with four rollers 4, two on each side, of which only two are visible in the drawings. The rollers 4 travel on a pair of tracks 5 which are provided by angle members running longitudinally along both sides of the lower frame. The rollers 4 are mounted on plates 6 which form part of the upper frame and which extend below the level of the tracks 5 to prevent the rollers 4 from slipping sideways with respect to the tracks. For further security a second set of four rollers may be provided, each roller of the second set being below a respective one of the rollers 4, so that there are then four pairs of rollers with each pair enclosing the track 5 between them. It will be understood that alternative methods could be used for mounting the upper frame on the lower frame. For example the lower frame could be provided with rollers on which the upper frame could run, rather than the other way round, as shown in the drawings.

A mattress-supporting surface is mounted on top of the upper frame via angle members, and consists of a back section 7, a buttocks section 8, a thigh section 9 and a calf section 10. The back section 7 is mounted for pivotal movement about a transverse axis, a fact which will be apparent by comparing FIGS. 1, 2 and 3. For this purpose, the angle members 11 to which the back section 7 is connected, are mounted on the upper frame by pivotal connections 12. At the head end of each of the sections 11 there is provided a short downwardly extending shaft which, when the back section 7 is in the horizontal position shown in FIG. 1, rests on the track 5 of the lower section.

Pivotal movement of the back section 7, with simultaneous movement of the upper frame with respect to the lower frame, is effected using a motor 13 secured to the upper frame. The motor is operable to cause a threaded rod 33 to rotate. This engages a nut (not shown) secured within a tube 14. The distal end of the tube 14 is pivotally mounted between a pair of brackets 15 extending downwardly from across member 16 which, in turn, is pivotally mounted at its ends on the upper frame. Two arms 17 are each pivotally connected at one end to the lower frame, at a pivot point 31, and pivotally connected at the opposite end, by a connection 18, to a respective further arm 19 whose other end is secured at a point 32 to the cross member 16. Each of the connections 18 is provided with a roller 20 which bears on the underside of the back section 7.

The operation of the adjustable bed can be understood by considering the steps by which its configuration changes from that of FIG. 1 to FIG. 2 and thence to FIG. 3. To go from the configuration of FIG. 1 to FIG. 2, the motor 13 is operated to cause the rod 33 to rotate and, thereby, to cause the tube 14 to move towards the head end of the bed. This causes the cross member 16 to rotate in a direction which, as viewed from the right side of FIG. 2, is clockwise, the brackets 15 acting as crank arms. Rotation of the cross member 16 causes the arms 19 to pivot, thus causing the rollers 20 to rise, which in turn causes the back section 7 to pivot upwardly. Simultaneously the above-described pivotal movements, the upper frame is constrained to move leftwardly with respect to the lower frame 1, i.e. toward the head end. This is an inevitable consequence of the fact that as the rollers rise the longitudinal distance between the points 31 and 32 at which the 20 arms 17 are attached to the lower frame and the arms 19 are attached to the cross member 16 shortens. Continued movement of the tube 14 takes the bed from the configuration shown in FIG. 2 to that shown in FIG. 3.

It will be seen that the longitudinal movement of the upper frame with respect to the lower frame has the effect of keeping the head end of the back section in at substantially the same position longitudinally with respect to the lower frame, and therefore, with respect to any items, such as bedside cabinets, which may be positioned by the bed.

To take the bed from the configuration of FIG. 3 to that of FIG. 1, the above process is reversed. As the rollers 20 descend, the weight of the user forces the back section 7 to pivot downwardly to keep the back section in contact with those rollers.

What is claimed is:

1. An adjustable bed having a head end and a foot end, comprising a lower frame, an upper frame mounted on the lower frame for longitudinal movement with respect thereto; a supporting surface defined by a plurality of support members including at least a back support member adjacent the head end of the bed and connected to the upper frame for pivotal movement about a transverse axis; and back support adjustment means comprising:

at least one first arm pivotally connected to the lower frame at a first pivotal connection adjacent the head end thereof;

at least one second arm pivotally connected to the upper frame at a second pivotal connection adjacent the said transverse axis;

means pivotally connecting the first and second arms to one another at a third pivotal connection intermediate the said first and second pivotal connections;

support means, carried by the said third pivotal connection, arranged to support the back support member;

and drive means for producing longitudinal movement of the upper frame with respect to the lower frame and, simultaneously, vertical movement of the third pivotal connection and, thereby, upward pivotal movement of the back support member, movement of the upper frame towards the head end occurring when the third pivotal connection moves upwards, and movement of the upper frame towards the foot end occurring when the third pivotal connection moves downwards.

2. A bed according to claim 1, wherein the drive means is connected between the upper frame and the said second pivotal connection.

3. A bed according to claim 2, wherein the drive means comprises a motor mounted on the upper frame at a location nearer the foot end of the bed than the second pivotal connection, the motor serving to cause movement in a generally longitudinal direction of an actuator member the distal end of which is connected to the second pivotal connection in such a way as to cause the second arm to pivot and the upper frame to move longitudinally.

4. A bed according to claim 3, wherein the upper frame has a cross member providing the said second pivotal connection, the distal end of the actuator member being connected to the cross member via at least one crank arm extending downwardly therefrom.

5. A bed according to claim 1, wherein said support means is arranged to bear on the underside of the back support member.

6. A bed according to claim 5, wherein the said support means comprises at least one roller.

7. A bed according to claim 5 having a plurality of said support members in addition to said back support member.

8. An adjustable bed having a head end and a foot end, comprising a lower frame, an upper frame mounted on the lower frame for longitudinal movement with respect thereto; a supporting surface defined by a plurality of support members including at least a back support member adjacent the head end of the bed and connected to the upper frame for pivotal movement about a transverse axis; and back support adjustment means comprising:

at least one first arm pivotally connected to the lower frame at a first pivotal connection adjacent the head end thereof;

at least one second arm pivotally connected to the upper frame at a second pivotal connection adjacent the said transverse axis;

means pivotally connecting the first and second arms to one another at a third pivotal connection intermediate the said first and second pivotal connections;

support means, carried by the said third pivotal connection and arranged to bear on the underside of the back support member;

and drive means for producing longitudinal movement of the upper frame with respect to the lower frame and, simultaneously, vertical movement of the third pivotal connection and, thereby, upward pivotal movement of the back support member, movement of the upper frame towards the head end occurring when the third pivotal connection moves upwards, and movement of the upper frame towards the foot end occurring when the third pivotal connection moves downwards.

* * * * *